US009897098B2

(12) United States Patent
Hill et al.

(10) Patent No.: US 9,897,098 B2
(45) Date of Patent: Feb. 20, 2018

(54) GAS TURBINE ENGINE AXIAL DRUM-STYLE COMPRESSOR ROTOR ASSEMBLY

(71) Applicant: United Technologies Corporation, Hartford, CT (US)

(72) Inventors: James Hill, Tolland, CT (US); Brian Merry, Andover, CT (US); Gabriel Suciu, Glastonbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 490 days.

(21) Appl. No.: 14/793,503

(22) Filed: Jul. 7, 2015

(65) Prior Publication Data

US 2016/0032937 A1 Feb. 4, 2016

Related U.S. Application Data

(60) Provisional application No. 62/031,669, filed on Jul. 31, 2014.

(51) Int. Cl.
*F01D 5/06* (2006.01)
*F04D 29/08* (2006.01)
(Continued)

(52) U.S. Cl.
CPC ..... *F04D 29/083* (2013.01); *F01D 11/005* (2013.01); *F01D 11/006* (2013.01);
(Continued)

(58) Field of Classification Search
CPC ..... F04D 29/083; F04D 17/08; F04D 17/12; F04D 17/122; F04D 29/284;
(Continued)

(56) References Cited

U.S. PATENT DOCUMENTS

2007/0224047 A1* 9/2007 Falk ..... F04D 29/284 416/97 R
2010/0239424 A1* 9/2010 Maalouf ..... F01D 5/3038 416/219 R (Continued)

FOREIGN PATENT DOCUMENTS

EP 2236757 10/2010
EP 2586968 5/2013

OTHER PUBLICATIONS

Extended European Search Report dated Jan. 7, 2016 in European Application No. 15178808.0.

*Primary Examiner* — Christopher Verdier
(74) *Attorney, Agent, or Firm* — Snell & Wilmer, L.L.P.

(57) ABSTRACT

A gas turbine engine includes an axial compressor which includes a rotor assembly including a first rotor segment with a first inner rim, a first sealing surface, and a first aft engagement feature, and a second rotor segment positioned aft of the first rotor segment and having a second inner rim, a second sealing surface, and a second inner rim with a second fore engagement feature that is complementary to the first aft engagement feature. The first and second sealing surfaces are complementary to each other, and are bonded together via a transient liquid phase diffusion process. The first and second sealing surfaces are disposed on the outer rim. The first aft engagement member may be a notch that is complementary to the second fore engagement feature, which may be a shelf.

20 Claims, 6 Drawing Sheets

(51) Int. Cl.

| | |
|---|---|
| ***F04D 29/28*** | (2006.01) |
| ***F04D 17/12*** | (2006.01) |
| ***F01D 11/00*** | (2006.01) |
| ***F04D 17/08*** | (2006.01) |

(52) U.S. Cl.
CPC ..... *F04D 17/08* (2013.01); *F04D 17/122* (2013.01); *F04D 29/284* (2013.01); *F04D 29/286* (2013.01); *F05B 2230/236* (2013.01)

(58) Field of Classification Search
CPC ..... F04D 29/286; F04D 29/321; F01D 5/06; F01D 5/063; F01D 5/066; F01D 11/005; F01D 11/006; F05B 2230/236; F05D 2230/236
USPC ..... 416/198 A, 200 A, 201 R, 213 R, 213 A
See application file for complete search history.

(56) References Cited

U.S. PATENT DOCUMENTS

| | | | | |
|---|---|---|---|---|
| 2012/0292860 | A1 | 11/2012 | Moehrle et al. | |
| 2013/0108413 | A1* | 5/2013 | Suciu | F01D 11/006 415/115 |
| 2013/0108445 | A1* | 5/2013 | Suciu | F01D 5/026 416/95 |
| 2013/0108466 | A1* | 5/2013 | Suciu | F01D 5/027 416/96 R |
| 2013/0108468 | A1* | 5/2013 | Suciu | F01D 5/066 416/97 R |

* cited by examiner

GAS TURBINE ENGINE AXIAL DRUM-STYLE COMPRESSOR ROTOR ASSEMBLY

CROSS-REFERENCE TO RELATED APPLICATIONS

This application is a nonprovisional of, and claims priority to, and the benefit of U.S. Provisional Application No. 62/031,669, entitled "GAS TURBINE ENGINE AXIAL DRUM-STYLE COMPRESSOR ROTOR ASSEMBLY," filed on Jul. 31, 2014, which is hereby incorporated by reference in its entirety.

FIELD

The present disclosure relates generally to axial compressor portions of gas turbine engines and more specifically, to rotor assemblies having multiple rotor segments secured together to form a drum rotor.

BACKGROUND

Gas turbine engines generally include a compressor, such as an axial compressor, to pressurize inflowing air. Such axial compressors comprise a rotor assembly. Conventional rotor assemblies include a number of rotor segments bolted together to form the rotor assemblies. Typically, the rotor segments comprise structure such as bolt holes, tabs, and other features, which allow the rotor segments to be aligned and bolted together.

Such structures can increase the weight of each rotor segment. The time and materials required to manufacture the rotor segments may also be increased. Further, axial clamping loads required to maintain the bolted connection between rotor assemblies may increase stress in the outer and inner rim of the rotor segments.

SUMMARY

A gas turbine engine compressor in accordance with the present disclosure may include a first rotor segment comprising a first inner rim and a first sealing surface, wherein the inner rim comprises a first aft engagement feature; and a second rotor segment positioned aft of the first rotor segment and comprising a second inner rim and a second sealing surface, wherein the second inner rim comprises a second fore engagement feature that is complementary to the first aft engagement feature, wherein the first sealing surface and the second sealing surface are complementary to each other, and a portion of the first sealing surface and a portion of the second sealing surface are complementary to each other to form a u-shape, and wherein the first sealing surface and second sealing surface bonded together via a transient liquid phase diffusion process. The first sealing surface and second sealing surface may be disposed in a first outer rim and second outer rim, respectively. The second fore engagement feature may comprise a shelf and the first aft engagement feature comprises a notch. The compressor may further comprise a rear hub having a hub engagement feature disposed on a fore end that is complementary to a second aft engagement feature disposed on an aft end of the second rotor segment. The first rotor segment may be disposed at a fore end of the compressor and the second rotor assembly may comprise a plurality of blades.

A gas turbine engine in accordance with the present disclosure may include an axial high pressure compressor comprising a rotary assembly, wherein the rotary assembly may comprise a first rotor segment comprising a first inner rim and a first sealing surface, wherein the inner rim comprises a first aft engagement feature; and a second rotor segment positioned aft of the first rotor segment and comprising a second inner rim and a second sealing surface, wherein the second inner rim comprises a second fore engagement feature that is complementary to the first aft engagement feature, wherein the first sealing surface and the second sealing surface are complementary to each other, and a portion of the first sealing surface and a portion of the second sealing surface are complementary to each other to form a u-shape, and wherein the first sealing surface and second sealing surface bonded together via a transient liquid phase diffusion process. The first sealing surface and second sealing surface may be disposed in a first outer rim and second outer rim, respectively. The second fore engagement feature may comprise a shelf and the first aft engagement feature comprises a notch. The compressor may further comprise a rear hub having a hub engagement feature disposed on a fore end that is complementary to a second aft engagement feature disposed on an aft end of the second rotor segment. The first rotor segment may be disposed at a fore end of the compressor and the second rotor assembly may comprise a plurality of blades.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of embodiments herein makes reference to the accompanying drawings, which show embodiments by way of illustration. While these embodiments are described in sufficient detail to enable those skilled in the art to practice the inventions, it should be understood that other embodiments may be realized and that logical and mechanical changes may be made without departing from the spirit and scope of the inventions. Thus, the detailed description herein is presented for purposes of illustration only and not for limitation. For example, any reference to singular includes plural embodiments, and any reference to more than one component or step may include a singular embodiment or step. Also, any reference to attached, fixed, connected or the like may include permanent, removable, temporary, partial, full and/or any other possible attachment option.

As used herein, the term "complementary" means conforming to and/or opposite of an element or feature. For example, an second element that is complementary to a first element would comprise a configuration and/or shape that may conform with the first element, such as by having the opposite shape or configuration.

As used herein, "aft" refers to the direction associated with the tail of an aircraft, or generally, to the direction of exhaust of the gas turbine. As used herein, "fore" refers to the direction associated with the nose of an aircraft, or generally, to the direction of flight or motion.

Rotor assemblies in accordance with the present disclosure may comprise rotor segments coupled together without the use of bolts or screws. Specifically, rotor segments may be coupled to one another via a transient liquid phase bonding process. In such configurations, the rotor segments form a rotor assembly which acts as a drum having a nearly-contiguous outer rim and inner rim.

Figure 1:
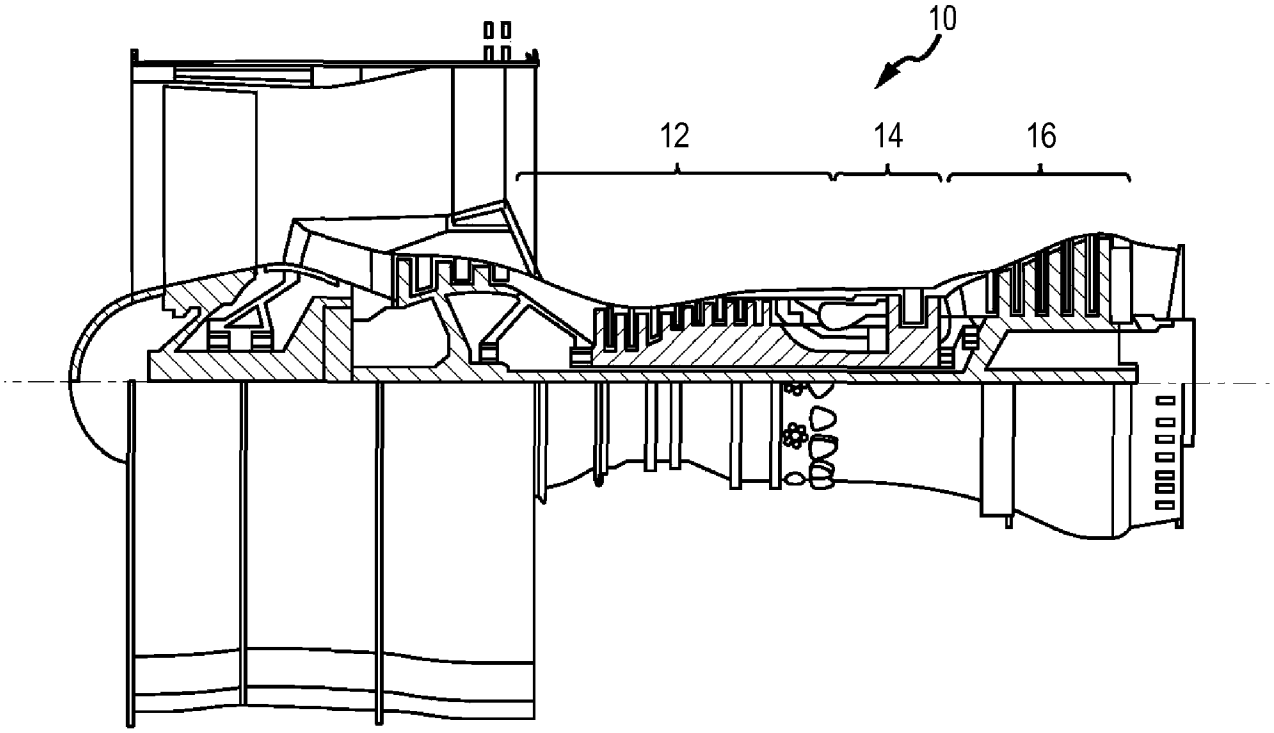
FIG. 1 illustrates, in accordance with various embodiments, a side view of a gas turbine engine.
Figure 2:
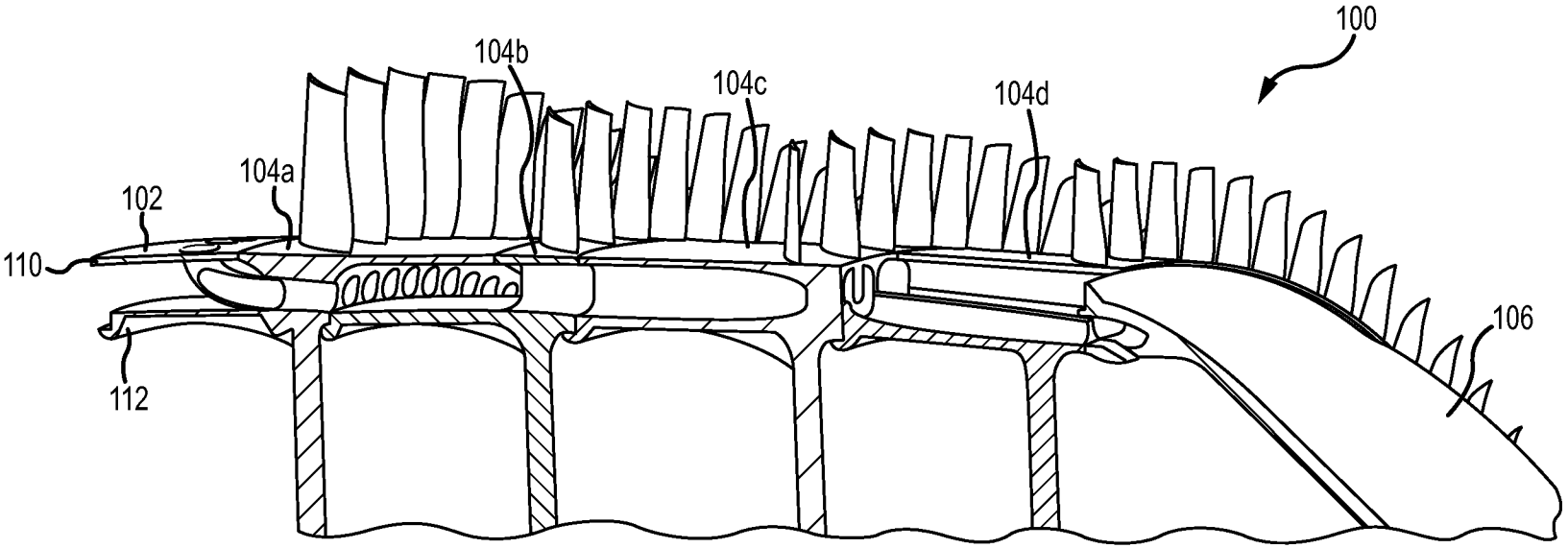
FIG. 2 illustrates, in accordance with various embodiments, a partial cross-sectional view of a compressor portion of a gas turbine engine.
Figure 3A:
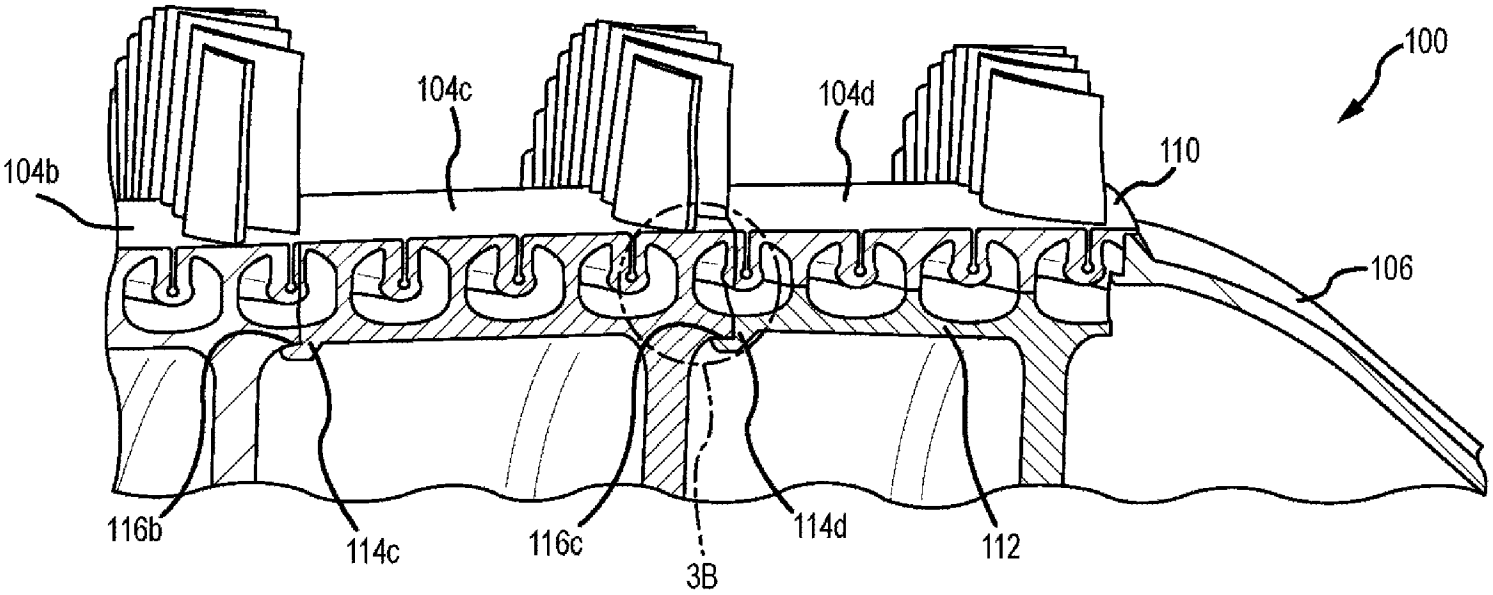
FIGS. 3A-3D illustrate, in accordance with various embodiments, partial cross-sectional views of a compressor portion of a gas turbine engine.
Figure 3B:
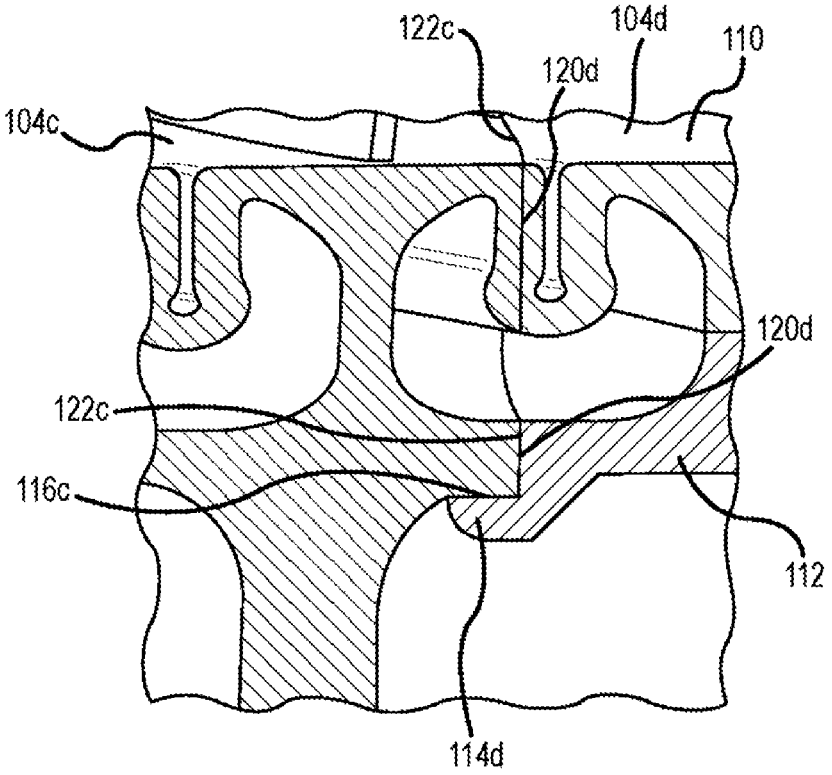
Figure 3C:
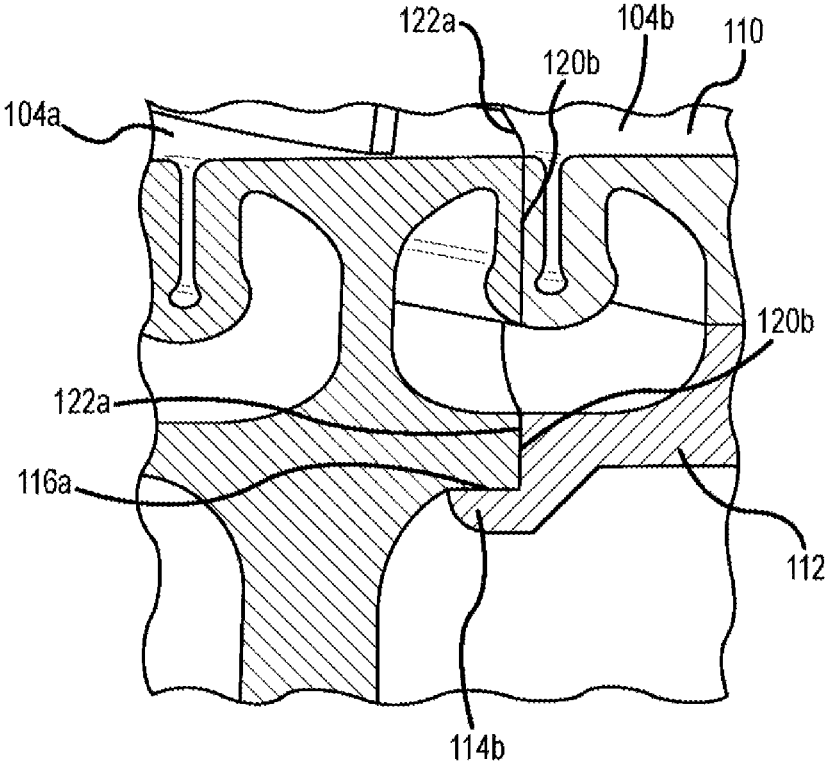
Figure 3D:
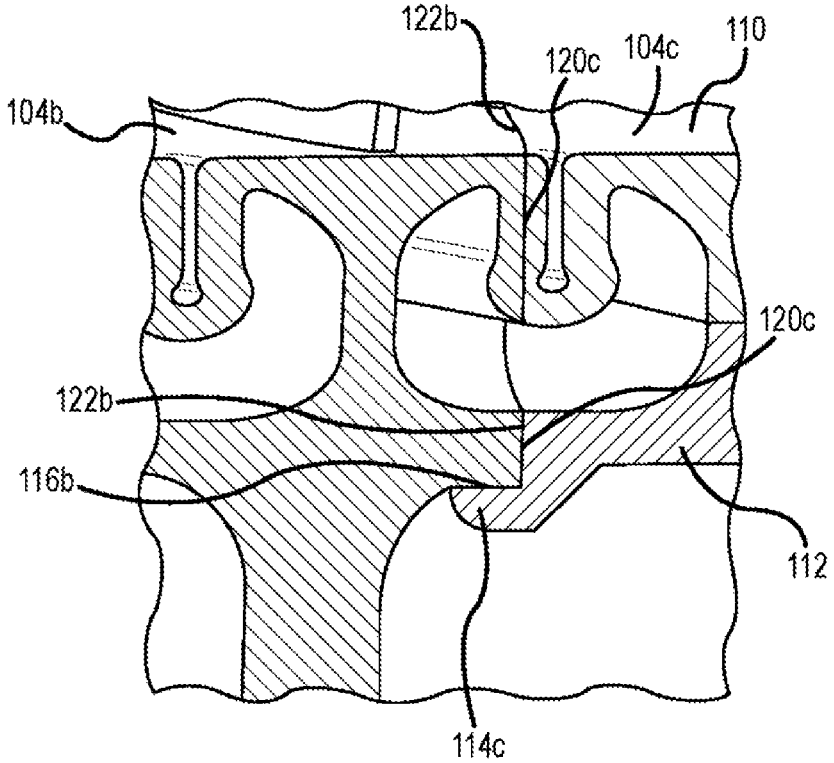

Accordingly, with reference to FIG. 1, a gas turbine engine 10 is shown. In general terms, gas turbine engine may comprise a compressor section 12. Air may flow through compressor section 12 and into a combustion chamber 14, where it is mixed with a fuel source and ignited to produce hot combustion gasses. These hot combustion gasses may drive a series of turbine blades within a turbine section 16, which in turn drive, for example, one or more compressor section blades mechanically coupled thereto.

With reference to FIGS. 2, and 3A-3D, compressor section 12 may comprise a high pressure section 100. High pressure section 100 may comprise, for example, a rotor assembly 102. In various embodiments, rotor assembly 102 comprises a plurality of rotor segments, such as rotor segments 104*a*-104*d*, coupled to one another in the axial direction. For example, one or more of rotor segments 104*a*-104*d* may comprise a plurality of rotor blades. As will be discussed in greater detail, rotor segments 104*a*-104*d* may be coupled to one another via a transient liquid phase bonding process.

In various embodiments, rotor segments of rotor assembly 102 may comprise complementary engagement features which align and engage the rotor segment to adjacent rotor segments. For example, rotor segments 104*a*-104*d* may comprise an outer rim 110 and an inner rim 112. In various embodiments, outer rim 110 may comprise engagement features which allow rotor segments 104*a*-104*d* to align and couple with each other. In further embodiments, inner rim 112 may comprise engagement features. In yet other embodiments, both outer rim 110 and inner rim 112 comprise engagement features. Any combination of features disposed along outer rim 110 and/or inner rim 112 which allow rotor segments 104*a*-104*d* to engage and couple with each other is within the scope of the present disclosure.

For example, a particular rotor, such as rotor segment 104*c*, may comprise a fore engagement feature 114*c*. For example, fore engagement feature 114*c* may comprise a shelf disposed at the fore end of rotor segment 104*c*. Fore engagement feature 114*c* may be disposed on inner rim 112 or outer rim 110.

Rotor segment 104*c* may further comprise an aft engagement feature 116*c*. For example, aft engagement feature 116*c* may comprise a notch disposed at the aft end of rotor segment 104*c*. In various embodiments, aft engagement feature 116*c* is shaped and configured such that it is complementary to a fore engagement feature 114 (of another rotor segment) which allows aft engagement feature 116*c* to engage with and couple to fore engagement feature 114 of an adjacent rotor segment. For example, aft engagement feature 116*c* may be complementary to and configured to engage with fore engagement feature 114*d* of rotor segment 104*d*. Further, rotor segment 104*c* may comprise fore engagement feature 114*c* that is complementary to an aft engagement feature 116*b* of rotor segment 104*b*. Although described with regard to specific embodiments, any complementary features such as fore engagement features 114 and aft engagement features 116 which allow adjacent rotor segments to align and engage are within the scope of the present disclosure. For example, rotor segments 104*a*-104*d* may comprise fore engagement features 114*b*-114*d* and aft engagement features 116*a*-116*c* that are reversed from or otherwise differently configured than the embodiments previously described.

In various embodiments, rotor assembly 102 comprises a fore rotor segment, such as rotor segment 104*a* and a plurality of rotor segments such as rotor segments 104*b*-104*d*. Fore rotor segment 104*a* may comprise an aft engagement feature 116*a* configured to engage with fore engagement feature 114*b* of rotor segment 104*b*. In various embodiments, fore rotor segment 104*a* differs from rotor segments 104*b*-104*d* in that fore rotor segment 104*a* does not comprise a fore engagement feature, such as 114*b*-114*d*.

Rotor assembly 102 may further comprise a rear hub 106. In various embodiments, rear hub 106 is located aft of the aft most rotor segment, such as rotor segment 104*d*. Rear hub 106 may comprise a fore engagement feature configured to engage with an aft engagement feature of aft most rotor segment 104*d*.

In various embodiments, rotor segments such as rotor segment 104*b* may comprise one or more fore sealing surfaces 120*b* and one or more aft sealing surfaces 122*b*. For example, rotor segment fore sealing surfaces 120*b* may be surfaces that are complementary to aft sealing surfaces of another segment, such as aft sealing surfaces of rotor segment 104*a*. Further, aft sealing surfaces 122*b* may be surfaces that are complementary to fore sealing surfaces 120*c* of rotor segment 104*c*. In various embodiments, sealing surfaces such as 120*a*-120*c* and 122*a*-122*c* may be configured to be aligned and held in contact with complementary sealing surfaces, allowing both surfaces to form an air-tight seal.

Rotor segments 104*a*-104*d* and rear hub 106 may, for example be fused together via a transient liquid phase bonding process. A transient liquid phase bonding process allows rotor segments 104*a*-104*d* to be fused together without using a traditional welding process. Benefits of using a transient liquid phase bonding process may include less cost and effort to clean surfaces after welding, reducing the accumulation of welding material within the rotors segments (also known as backsplash), and reducing the potential for stress, deformation, or other undesirable effect that may be introduced into the rotor segments by the heat of welding.

In various embodiments, rotor segments, such as rotor segment 104*b* and 104*c*, for example, are aligned and partially engaged with each other by coupling fore engagement feature 114*c* and aft engagement feature 116*b* and aligning fore sealing surface 120*c* and aft sealing surface 122*b*. Once aligned, a suitable bonding liquid may be applied to one or more surfaces, components, or features of rotor segment 104*b* and/or 104*c* to fuse the two rotor segments. In various embodiments, a suitable bonding liquid may be applied to fore sealing surface 120*b* and/or aft sealing surface 120*c*. In further embodiments, a suitable liquid may be applied to fore engagement feature 114*c* and aft engagement feature 116*b*. Once a suitable liquid has been applied to the desired surface and/or feature (e.g., surfaces 120*c* and 122*b*, engagement features 114*c* and 116*b*), sealing surfaces 120*c* and 122*b* may be brought in contact with each other, such that the liquid fuses rotor segments 104*b* and

104*c* together. This process may be repeated for each rotor segment, including segments 104*a*-104*d* and rear hub 106.

In various embodiments, suitable liquids for the transient liquid phase bonding of rotor segments 104*a*-104*d* and rear hub 106 may comprise, for example, tin, copper, nickel, or indium. Suitable transient liquid phase bonding liquids may, for example, facilitate interdiffusion between two surfaces such that the material of the surfaces (the "parent material") is in a non-eutectic state. This allows the bonding of the surfaces to near the melting point of the parent material, instead of at a lower melting point (as is the case with other techniques, such as conventional brazing processes). As such, liquids having suitable melting point temperature and solubility and diffusivity in the material of the rotor segments, and is capable of fusing rotor segments 104*a*-104*d* and rear hub 106, are within the scope of the present disclosure. Although the figures and description show only four rotor segments, it would be understood by those of ordinary skill in the art that the features and bonding described herein may be applied to engines with fewer or more rotor segments.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A gas turbine engine compressor comprising:

a first rotor segment comprising a first inner rim and a first aft sealing surface, wherein the first inner rim comprises a first aft engagement feature; and a second rotor segment positioned aft of the first rotor segment and comprising a second inner rim and a second fore sealing surface, wherein the second inner rim comprises a second fore engagement feature, wherein the first aft sealing surface and the second fore sealing surface are complementary to each other and a portion of the first aft sealing surface and a portion of the second aft sealing surface are complementary to each other to form a u-shape.

2. The gas turbine engine compressor of claim 1, wherein the first aft sealing surface is disposed in a first outer rim and the second fore sealing surface is disposed in a second outer rim.

3. The gas turbine engine compressor of claim 1, wherein the second fore engagement feature comprises a shelf.

4. The gas turbine engine compressor of claim 3, wherein the first aft engagement feature comprises a notch.

5. The gas turbine engine compressor of claim 1, further comprising a rear hub which includes a hub engagement feature disposed on a fore end of the rear hub, the hub engagement feature complementary to a second aft engagement feature disposed on an aft end of the second rotor segment.

6. The gas turbine engine compressor of claim 1, wherein the first rotor segment is a fore rotor segment.

7. The gas turbine engine compressor of claim 1, wherein the first fore sealing surface and the second aft sealing surface have a first bond.

8. The gas turbine engine compressor of claim 1, further comprising a third rotor assembly coupled to the second rotor segment, the third rotor assembly comprising a third aft engagement feature and a third fore engagement feature.

9. The gas turbine engine compressor of claim 8, wherein the third fore engagement feature is complementary to the second aft engagement feature of the second rotor segment.

10. The gas turbine engine compressor of claim 1, wherein the first rotor segment and the second rotor segment combine to form a drum made with a transient liquid.

11. A gas turbine engine comprising:

an axial compressor comprising a rotary assembly, wherein the rotary assembly comprises a first rotor segment comprising a first inner rim and a first aft sealing surface, wherein the first inner rim comprises a first aft engagement feature; and a second rotor segment positioned aft of the first rotor segment and comprising a second inner rim and a second fore sealing surface, wherein the second inner rim comprises a second fore engagement feature that is complementary to the first aft engagement feature, wherein the first aft sealing surface and the second fore sealing surface are complementary to each other and and a portion of the first aft sealing surface and a portion of the second aft sealing surface are complementary to each other to form a u-shape.

12. The gas turbine engine of claim 11, wherein the first aft sealing surface is disposed in a first outer rim and the second fore sealing surface is disposed in a second outer rim.

13. The gas turbine engine of claim 11, wherein the second fore engagement feature comprises a shelf.

14. The gas turbine engine of claim 13, wherein the first aft engagement feature comprises a notch.

15. The gas turbine engine of claim 11, further comprising a rear hub having a hub engagement feature disposed on a fore end of the rear hub, the hub engagement feature being complementary to a second aft engagement feature disposed on an aft end of the second rotor segment.

16. The gas turbine engine of claim 11, wherein the first rotor segment is a fore rotor segment.

17. The gas turbine engine of claim 11, wherein the second rotor segment comprises a plurality of blades.

18. The gas turbine engine of claim 11, further comprising a third rotor assembly comprising a third aft engagement feature and a third fore engagement feature.

19. The gas turbine engine of claim 18, wherein the third fore engagement feature is complementary to the second aft engagement feature of the second rotor segment.

20. The gas turbine engine of claim 11, wherein the first rotor segment and the second rotor segment combine to form a drum made with a transient liquid.

* * * * *